US008033906B2

(12) United States Patent
Joshi et al.

(10) Patent No.: US 8,033,906 B2
(45) Date of Patent: Oct. 11, 2011

(54) WAGERING GAME WITH INVITATION FOR PLAYING A WAGERING GAME AT A SUBSEQUENT GAMING SESSION

(75) Inventors: Shridhar P. Joshi, Naperville, IL (US); Peter W. Flemming, Oak Park, IL (US); Benjamin T. Gomez, Chicago, IL (US); Richard T. Schwartz, Chicago, IL (US)

(73) Assignee: WMS Gaming Inc., Waukegan, IL (US)

( * ) Notice: Subject to any disclaimer, the term of this patent is extended or adjusted under 35 U.S.C. 154(b) by 578 days.

(21) Appl. No.: 11/253,899

(22) Filed: Oct. 19, 2005

(65) Prior Publication Data

US 2006/0089194 A1 Apr. 27, 2006

Related U.S. Application Data

(60) Provisional application No. 60/620,936, filed on Oct. 21, 2004.

(51) Int. Cl.
*A63F 9/24* (2006.01)

(52) U.S. Cl. ..... 463/20; 463/25; 463/29

(58) Field of Classification Search ..... 463/22, 463/16–20, 25, 29
See application file for complete search history.

(56) References Cited

U.S. PATENT DOCUMENTS

| | | | | |
|---|---|---|---|---|
| 4,752,068 | A | 6/1988 | Endo | 273/1 |
| 5,575,474 | A | 11/1996 | Rossides | 463/26 |
| 5,609,525 | A | 3/1997 | Ohno et al. | 463/43 |
| 5,833,537 | A | 11/1998 | Barrie | 463/21 |
| 5,836,817 | A * | 11/1998 | Acres et al. | 463/26 |
| 5,957,775 | A | 9/1999 | Cherry | 463/16 |
| 6,004,211 | A | 12/1999 | Brenner et al. | 463/40 |
| 6,012,045 | A | 1/2000 | Barzilai | 705/37 |
| 6,012,983 | A | 1/2000 | Walker et al. | 463/20 |
| 6,015,344 | A | 1/2000 | Kelly et al. | 463/16 |
| 6,068,553 | A | 5/2000 | Parker | 463/27 |
| 6,077,163 | A | 6/2000 | Walker et al. | 463/26 |
| 6,113,098 | A | 9/2000 | Adams | 273/143 |
| 6,165,071 | A | 12/2000 | Weiss | 463/24 |
| 6,193,608 | B1 * | 2/2001 | Walker et al. | 463/25 |
| 6,234,896 | B1 * | 5/2001 | Walker et al. | 463/16 |
| 6,254,481 | B1 | 7/2001 | Jaffe | 463/20 |
| 6,254,483 | B1 | 7/2001 | Acres | 463/26 |
| 6,273,820 | B1 | 8/2001 | Haste, III | 463/40 |
| 6,302,790 | B1 | 10/2001 | Brossard | 463/20 |
| 6,311,976 | B1 | 11/2001 | Yoseloff et al. | 273/138 |
| 6,319,127 | B1 | 11/2001 | Walker et al. | 463/26 |
| 6,364,765 | B1 | 4/2002 | Walker et al. | 463/16 |
| 6,364,766 | B1 | 4/2002 | Anderson et al. | 463/16 |
| 6,365,765 | B1 | 4/2002 | Baldwin et al. | 556/440 |

(Continued)

FOREIGN PATENT DOCUMENTS

| | | |
|---|---|---|
| WO | WO 9929381 | 6/1999 |

(Continued)

*Primary Examiner* — Omkar Deodhar
(74) *Attorney, Agent, or Firm* — Nixon Peabody LLP

(57) ABSTRACT

A gaming terminal and method of playing a wagering game. The terminal including a wagering game having a plurality of symbols that indicate a randomly selected outcome of the wagering game. The wagering game provides the player with an option to accept an invitation immediately redeemable for playing the wagering game or an invitation to a wagering game opportunity redeemable at a subsequent gaming session.

18 Claims, 4 Drawing Sheets

U.S. PATENT DOCUMENTS

| | | | | |
|---|---|---|---|---|
| 6,431,983 | B2 | 8/2002 | Acres | 463/25 |
| 6,506,117 | B2 | 1/2003 | DeMar et al. | 463/20 |
| 6,506,118 | B1 | 1/2003 | Baerlocher et al. | 463/25 |
| 6,605,001 | B1 * | 8/2003 | Tarantino | 463/22 |
| 6,663,489 | B2 | 12/2003 | Baerlocher | 463/20 |
| 6,722,981 | B2 | 4/2004 | Kaminkow | 463/20 |
| 6,722,985 | B2 | 4/2004 | Criss-Puszkiewicz et al. | 463/29 |
| 6,745,236 | B1 | 6/2004 | Hawkins et al. | 709/203 |
| 6,758,757 | B2 | 7/2004 | Luciano, Jr. et al. | 463/46 |
| 6,776,713 | B2 | 8/2004 | Gauselmann | 463/16 |
| 6,780,111 | B2 | 8/2004 | Cannon et al. | 463/25 |
| 6,800,027 | B2 | 10/2004 | Giobbi et al. | 463/24 |
| 6,811,486 | B1 | 11/2004 | Luciano, Jr. | 463/24 |
| 6,923,721 | B2 | 8/2005 | Luciano et al. | 463/24 |
| 7,182,690 | B2 | 2/2007 | Giobbi et al. | 463/24 |
| 2001/0024971 | A1 | 9/2001 | Brossard | 463/30 |
| 2002/0028708 | A1 | 3/2002 | Busch et al. | 463/42 |
| 2002/0039919 | A1 | 4/2002 | Joshi et al. | 463/20 |
| 2002/0077173 | A1 | 6/2002 | Luciano, Jr. et al. | 463/25 |
| 2002/0077174 | A1 | 6/2002 | Luciano, Jr. et al. | 463/25 |
| 2002/0093136 | A1 | 7/2002 | Moody | 273/139 |
| 2002/0094871 | A1 | 7/2002 | Luciano, Jr. et al. | 463/43 |
| 2002/0107065 | A1 | 8/2002 | Rowe | 463/20 |
| 2002/0128057 | A1 * | 9/2002 | Walker et al. | 463/20 |
| 2002/0151349 | A1 | 10/2002 | Joshi | 463/20 |
| 2002/0196342 | A1 | 12/2002 | Walker et al. | 348/157 |
| 2003/0013515 | A1 | 1/2003 | Rowe et al. | 463/25 |
| 2003/0013531 | A1 | 1/2003 | Rowe et al. | 463/42 |
| 2003/0036422 | A1 | 2/2003 | Baerlocher et al. | 463/20 |
| 2003/0036427 | A1 | 2/2003 | Brandstetter et al. | 463/29 |
| 2003/0064794 | A1 | 4/2003 | Mead et al. | 463/25 |
| 2003/0078101 | A1 | 4/2003 | Schneider et al. | 463/42 |
| 2003/0100362 | A1 | 5/2003 | Horniak et al. | 463/25 |
| 2003/0106769 | A1 | 6/2003 | Weiss | 463/25 |
| 2003/0114219 | A1 | 6/2003 | McClintic | 463/25 |
| 2003/0119579 | A1 | 6/2003 | Walker et al. | 463/21 |
| 2003/0157979 | A1 | 8/2003 | Cannon et al. | 463/16 |
| 2003/0195024 | A1 | 10/2003 | Slattery | 463/9 |
| 2003/0211881 | A1 | 11/2003 | Walker et al. | 463/20 |
| 2004/0053680 | A1 | 3/2004 | Schultz | 463/20 |
| 2004/0142742 | A1 | 7/2004 | Schneider et al. | 463/29 |
| 2004/0209662 | A1 | 10/2004 | Wadleigh | 463/16 |
| 2005/0003886 | A1 | 1/2005 | Englman et al. | 463/25 |
| 2005/0159207 | A1 | 7/2005 | Thomas | 463/20 |
| 2006/0068893 | A1 | 3/2006 | Jaffe et al. | 463/20 |
| 2006/0079316 | A1 | 4/2006 | Flemming et al. | 463/25 |
| 2006/0079317 | A1 | 4/2006 | Flemming et al. | 463/20 |
| 2006/0084495 | A1 | 4/2006 | Jaffe et al. | 463/20 |
| 2006/0084496 | A1 | 4/2006 | Jaffe et al. | 463/20 |
| 2006/0089194 | A1 | 4/2006 | Joshi et al. | 463/25 |
| 2007/0254734 | A1 | 11/2007 | Gilmore et al. | 463/20 |
| 2007/0259706 | A1 | 11/2007 | Anderson et al. | 463/16 |
| 2007/0259713 | A1 | 11/2007 | Fiden et al. | 463/25 |
| 2007/0265060 | A1 | 11/2007 | Hornik et al. | 463/20 |
| 2007/0298856 | A1 | 12/2007 | Gilmore et al. | 463/16 |
| 2008/0113770 | A1 | 5/2008 | Gelber et al. | 463/25 |

FOREIGN PATENT DOCUMENTS

| | | | |
|---|---|---|---|
| WO | WO 2005082480 | A1 | 9/2005 |
| WO | WO 2006002241 | A2 | 1/2006 |
| WO | WO 2006004831 | A2 | 1/2006 |
| WO | WO 2006004832 | A2 | 1/2006 |
| WO | WO 2006005073 | A2 | 1/2006 |
| WO | WO 2006017036 | A1 | 2/2006 |
| WO | WO 2006017067 | A1 | 2/2006 |
| WO | WO 2006017068 | A1 | 2/2006 |
| WO | WO 2006020811 | A2 | 2/2006 |
| WO | WO 2006026250 | A2 | 3/2006 |
| WO | WO 2006044252 | A2 | 4/2006 |
| WO | WO 2007/103054 | A2 | 9/2007 |
| WO | WO 2008/048634 | A2 | 4/2008 |

* cited by examiner

WAGERING GAME WITH INVITATION FOR PLAYING A WAGERING GAME AT A SUBSEQUENT GAMING SESSION

RELATED APPLICATION

The present application claims priority to U.S. Provisional Patent Application Ser. No. 60/620,936, entitled "Wagering Game With Invitation For Playing A Wagering Game At A Subsequent Gaming Session" filed on Oct. 21, 2004, which is incorporated herein by reference in its entirety.

FIELD OF THE INVENTION

The present invention relates generally to gaming terminals, and more particularly, to a gaming terminal having an award that may be redeemed at a future gaming session.

BACKGROUND OF THE INVENTION

Gaming machines or gaming terminals, such as slot machines, video poker machines, and the like, have been a cornerstone of the gaming industry for several years. Generally, the popularity of such machines with players is dependent on the likelihood (or perceived likelihood) of winning money at the machine and the intrinsic entertainment value of the machine relative to other available gaming options. Where the available gaming options include a number of competing machines and the expectation of winning each machine is roughly the same (or believed to be the same), players are most likely to be attracted to the most entertaining and exciting of the machines.

Consequently, shrewd operators strive to employ the most entertaining and exciting machines available because such machines attract frequent play and, hence, increase profitability to the operator. In the competitive gaming machine industry, there is a continuing need for gaming machine manufacturers to produce new types of games, or enhancements to existing games, which will attract frequent play by enhancing the entertainment value and excitement associated with the game.

One concept that has been successfully employed to enhance the entertainment value of a game is that of a "bonus" game which may be played in conjunction with a "basic" game. The bonus game may comprise any type of game, either similar to or completely different from the basic game, and is entered upon the occurrence of a selected event or outcome of the basic game. Such a bonus game produces a significantly higher level of player excitement than the basic game because it provides a greater expectation of winning than the basic game.

In current basic games and bonus games the player is provided with little incentive to return the game at a later time. Once the player chooses to stop playing the game in that round, the player is immediately awarded any credits that are remaining and also loses assets that have been accumulated, but not yet awarded. For example, in some games, the bonus game consists of the player collecting assets and when a certain number or combination of assets is accumulated, the player wins an award. However, should the player choose to leave the game prior to winning the award, the player loses all of the assets accumulated. This can cause player frustration and does not provide the player with any incentive to return to the game.

Such a system also encourages "vulturing," in which the "vulturing" player waits for a person who is close to winning an award to leave the gaming machine prior to the winning of the award. The "vulturing" player then begins to play the machine, and may quickly win the award without investing much time into the game. This is also frustrating for other players.

Thus, there is a need to allow a player to accumulate assets on gaming terminals and to have those assets restored to him or her should the player return to the game at a later time. This way, should a player choose to leave a game, anything the player has accumulated during the game goes with them and is restored at a later time when the player returns to the game. This alleviates the player frustration at losing assets that they have accumulated and also provides the player an incentive to return to the game at a later date.

SUMMARY OF THE INVENTION

According to one embodiment of the present invention a gaming terminal comprises a wagering game. The wagering game has a plurality of symbols that indicate a randomly selected outcome of the wagering game. In response to an occurrence of predefined condition, the wagering game provides the player with an option to accept an invitation immediately redeemable for playing the wagering game, or obtaining an invitation to a wagering game opportunity redeemable at a subsequent gaming session.

According to one method of playing a wagering game having at least a basic game the method conducts the basic game at a gaming terminal. Results of the basic game are displayed on a display. The method provides an award based on a predefined outcome of the basic game. If the invitation-achieving outcome is present, the gaming terminal awards the player an invitation to play a wagering game.

According to another embodiment of the present invention a gaming system comprises at least one gaming terminal for displaying a wagering game, and a controller coupled to the at least one gaming terminal. The wagering game has a randomly selected outcome. One of the randomly selected outcomes is an invitation-achieving outcome to a wagering game. The controller operates to cause the display to display a first invitation award option and a second invitation award option in response to achieving the invitation-achieving outcome. The controller operates to issue an invitation in response to a player accepting the second invitation award option.

According to a further embodiment of the present invention a gaming terminal comprises a wagering game, and a printer. The wagering game has a plurality of symbols that indicate a randomly selected outcome of the wagering game. The printer provides the player with a paper invitation to a wagering game opportunity. In response to a predefined condition, the wagering game provides the player with an option to accept an invitation immediately redeemable for playing the wagering game, or obtaining the paper invitation for a wagering game opportunity redeemable at a later time from the printer.

According to another method of playing a wagering game having at least a basic game the method conducts the basic game at a first gaming session on a gaming terminal. A randomly selected outcome of the basic game is displayed on a display of the gaming terminal. The method awards the player an invitation to play a wagering game in response to the randomly selected outcome being an invitation-achieving outcome. The award of the invitation to play a wagering game is for a subsequent gaming session. At the subsequent gaming session, the method redeems the invitation to play the wagering game.

The above summary of the present invention is not intended to represent each embodiment or every aspect of the present invention. The detailed description and Figures will describe many of the embodiments and aspects of the present invention.

BRIEF DESCRIPTION OF THE DRAWINGS

The foregoing and other advantages of the invention will become apparent upon reading the following detailed description and upon reference to the drawings.

Figure 1:
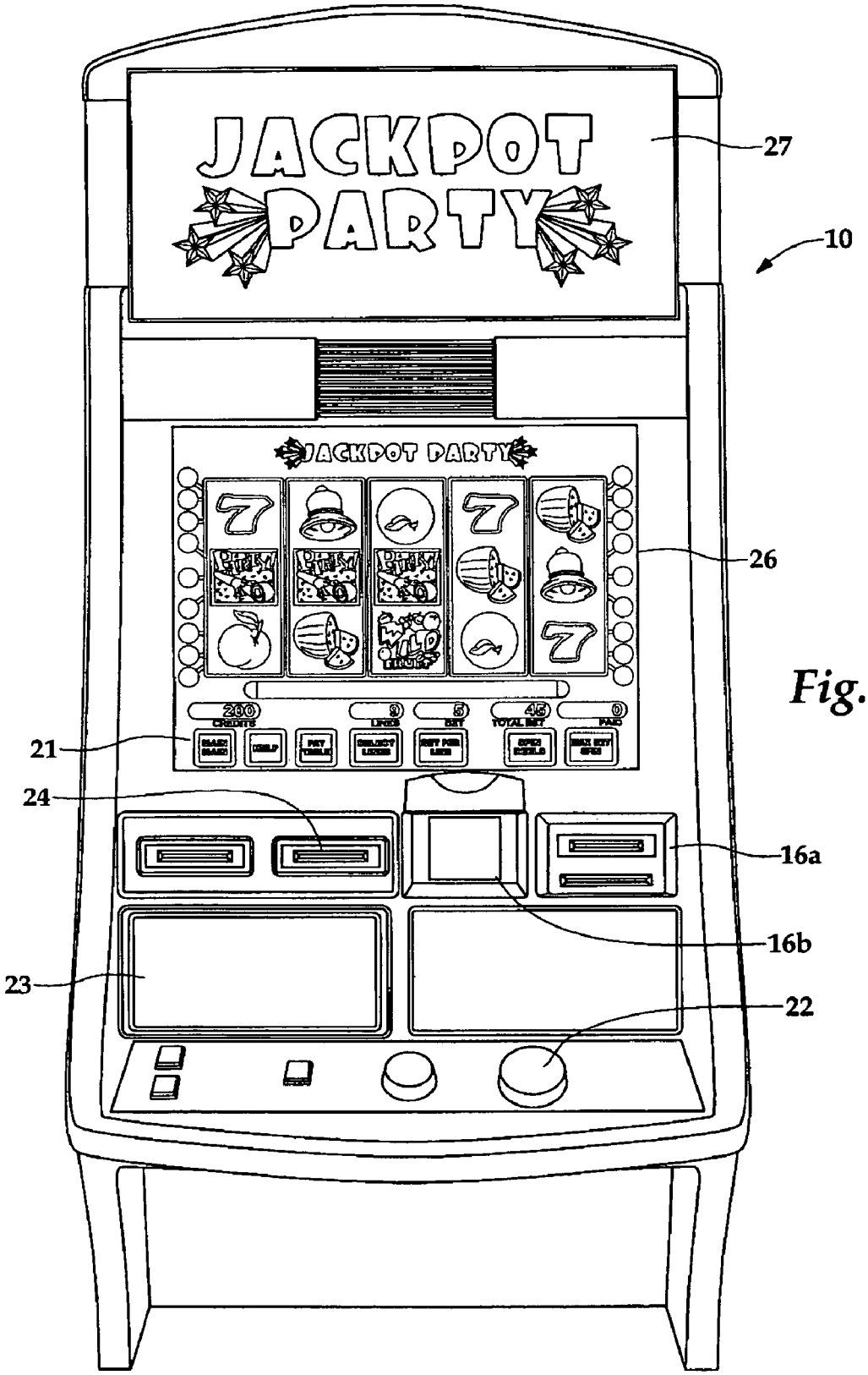
FIG. 1 is a front view of a video gaming terminal according to one embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DESCRIPTION OF ILLUSTRATIVE EMBODIMENTS

FIG. 1 shows a front view of a typical gaming terminal 10 used by gaming establishments, such as casinos. With regard to the present invention, the gaming terminal 10 may be any type of gaming terminal and may have varying structures and methods of operation. For example, the gaming terminal 10 may be a mechanical gaming terminal configured to play mechanical slots, or it may be an electromechanical or electrical gaming terminal configured to play video slots or a video casino game, such as blackjack, slots, keno, poker, etc.

As shown, the gaming terminal 10 includes input devices, such as a wager acceptor 16 (shown as a card wager acceptor 16*a* and a cash wager accepter 16*b*), a touch screen 21, a push-button panel 22, and an information reader 24. For outputs, the gaming terminal 10 includes a payout mechanism 23, a main display 26 for displaying information about the basic wagering game, and a secondary display 27 that may display an electronic version of a pay table, and/or also possibly game-related information or other entertainment features. While these typical components found in the gaming terminal 10 are described below, it should be understood that numerous other elements may exist and may be used in any number of combinations to create various forms of a gaming terminal.

The wager acceptor 16 may be provided in many forms, individually or in combination. The cash wager acceptor 16*a* may include a coin slot acceptor or a note acceptor to input value to the gaming terminal 10. The card wager acceptor 16*b* may include a card-reading device for reading a card that has a recorded monetary value with which it is associated. The card wager acceptor 16*b* may also receive a card that authorizes access to a central account, which can transfer money to the gaming terminal 10.

Also included is the payout mechanism 23, which performs the reverse functions of the wager acceptor. For example, the payout mechanism 23 may include a coin dispenser or a note dispenser to output value from gaming terminal 10. Also, the payout mechanism 23 may also be adapted to receive a card that authorizes the gaming terminal to transfer credits from the gaming terminal 10 to a central account.

The push button panel 22 is typically offered, in addition to the touch screen 21, to provide players with an option on how to make their game selections. Alternatively, the push button panel 22 provides inputs for one aspect of operating the game, while the touch screen 21 allows for inputs needed for another aspect of operating the game.

The outcome of the basic wagering game is displayed to the player on the main display 26. The main display 26 may take the form of a cathode ray tube (CRT), a high resolution LCD, a plasma display, LED, or any other type of video display suitable for use in the gaming terminal 10. As shown, the main display 26 includes the touch screen 21 overlaying the entire monitor (or a portion thereof) to allow players to make game-related selections. Alternatively, the gaming terminal 10 may have a number of mechanical reels to display the game outcome, as well.

In some embodiments, the information reader 24 is a card reader that allows for identification of a player by reading a card with information indicating his or her true identity. Currently, identification is used by gaming establishments for rewarding certain players with complimentary services or special offers. For example, a player may be enrolled in the gaming establishment's players' club and may be awarded certain complimentary services as that player collects points in his or her player-tracking account. The player inserts his or her card into the player-identification card reader 24, which allows the gaming establishment's computers to register that player's wagering at the gaming terminal 10. The information reader 24 may also include a keypad (not shown) for entering a personal identification number (PIN). The gaming terminal 10 may require that the player enter their PIN prior to obtaining information. The gaming terminal 10 may use the secondary display 27 for providing the player with information about his or her account or other player-specific information. Also, in some embodiments, the information reader 24 may be used to restore assets that the player achieved during a previous game session and had saved.

Figure 2:
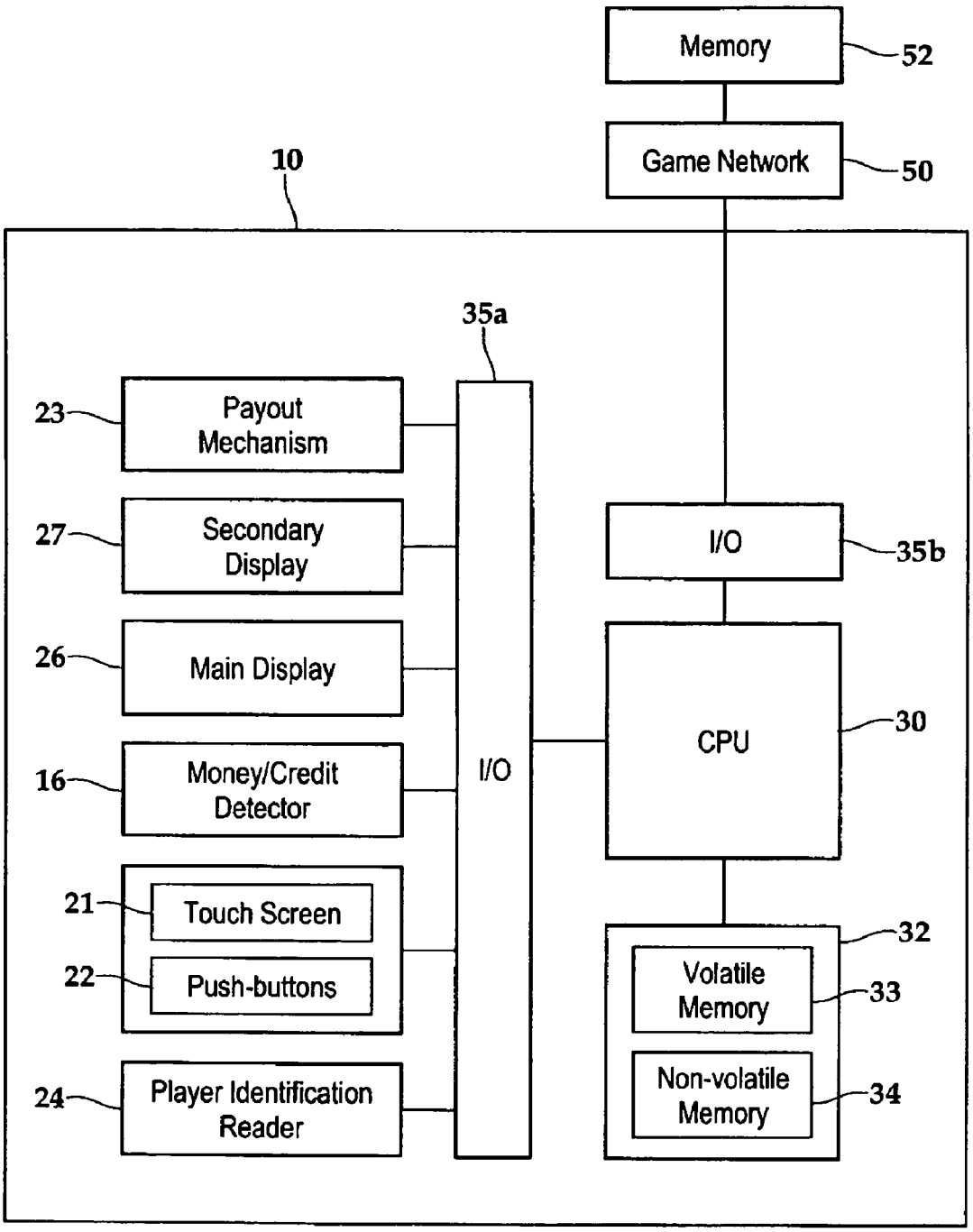
FIG. 2 is a block diagram of the gaming terminal of FIG. 1.

As shown in FIG. 2, the various components of the gaming terminal 10 are controlled by a central processing unit (CPU) 30 (such as a microprocessor or microcontroller). To provide the gaming functions, the CPU 30 executes one or more game programs stored in a computer readable storage medium, in the form of a local memory 32 that allows for the randomly selected outcome. The CPU 30 is also coupled to or includes a local memory 32. The local memory 32 may comprise a volatile memory 33 (e.g., a random-access memory (RAM)) and a non-volatile memory 34 (e.g., an EEPROM). It should be appreciated that the CPU 30 may include one or more microprocessors. Similarly, the local memory 32 may include multiple RAM and multiple program memories.

Communications between the peripheral components of the gaming terminal 10 and the CPU 30 occur through input/output (I/O) circuits 35*a*. As such, the CPU 30 also controls and receives inputs from the peripheral components of the gaming terminal 10. Further, the CPU 30 communicates with external systems via the I/O circuits 35*b*. Although the I/O circuits 35 may be shown as a single block, it should be appreciated that the I/O circuits 35 may include a number of different types of I/O circuits.

In some embodiments the gaming terminal 10 may be part of a game network 50 that consists of numerous gaming terminals 10. The game network 50 can include progressive jackpots that are contributed to by all or some of the gaming terminals 10 in the network (e.g., terminal-level jackpots that only each terminal 10 contributes to, bank-level jackpots that are contributed to by all of the terminals 10 in a particular bank, and wide-area jackpots that are contributed to by a larger number of terminals 10, such as multiple banks). Alternatively, the game network 50 can allow the player to retrieve assets obtained while playing one terminal 10 at a different gaming terminal that is also part of the game network. Assets may be any number of things, including, but not limited to, monetary or non-monetary awards, features that a player builds up in a bonus or progressive game to win awards, etc.

In some embodiments, the CPU 30 is also used with the information reader 24 to restore saved assets. For example, in one embodiment, the information reader 24 is adapted to receive a ticket 62 (FIG. 4). The ticket 62 includes a unique identifier. The unique identifier links the ticket 62 to a file contained within the local memory 32 or a system memory 52 located in the game network 50. The file includes the assets that are being stored from a previous game. One example of an asset that is stored from a previous game is an invitation, as discussed in connection with FIG. 3. Monetary awards include game credits or money, while the non-monetary awards can be free plays (e.g., free spins), multipliers, or access to basic, bonus, and/or progressive games.

When a player inserts a ticket 62 into the information reader 24, the CPU 30 obtains the unique identifier and causes the appropriate memory 32, 52 to be searched, and the file containing the unique identifier matching the identifier on the ticket 62 is retrieved. Any assets or other information contained in this file are then transmitted to the gaming terminal 10, and the player regains any assets that were saved during a previous game. This allows the player to keep assets even after a particular gaming session ends, which increases player commitment to a game and decreases vulturing.

In other embodiments, the information reader 24 may include a card reader, and the unique identifier provided at the gaming terminal 10 may be stored on a personal identification card, such as one described above. Or, the gaming terminal 10 includes a radio frequency identification device (RFID) transceiver or receiver so that an RFID transponder held by the player can be used to provide the unique identifier of the player at the gaming terminal 10 without the need to insert a card into the gaming terminal 10. RFID components can be those available from Pacific Northwest National Laboratory (under the United States Department of Energy) of Richland, Wash.

In other embodiments, the information reader 24 may include a biometric reader, such as a finger, hand, or retina scanner, and the unique identifier may be the scanned biometric information. Additional information regarding biometric scanning, such as fingerprint scanning or hand geometry scanning, is available from International Biometric Group LLC of New York, N.Y. Other biometric identification techniques can be used as well for providing a unique identifier of the player. For example, a microphone can be used in a biometric identification device on the gaming terminal so that the player can be recognized using a voice recognition system.

In summary, there are many techniques in which to provide a unique identifier for the player so that the assets accumulated by the player during one wagering session can be stored in either the system or local memory 52, 32, thereby allowing the player to subsequently access those assets at the same gaming terminal 10 or a different gaming terminal within the network 50.

Figure 3:
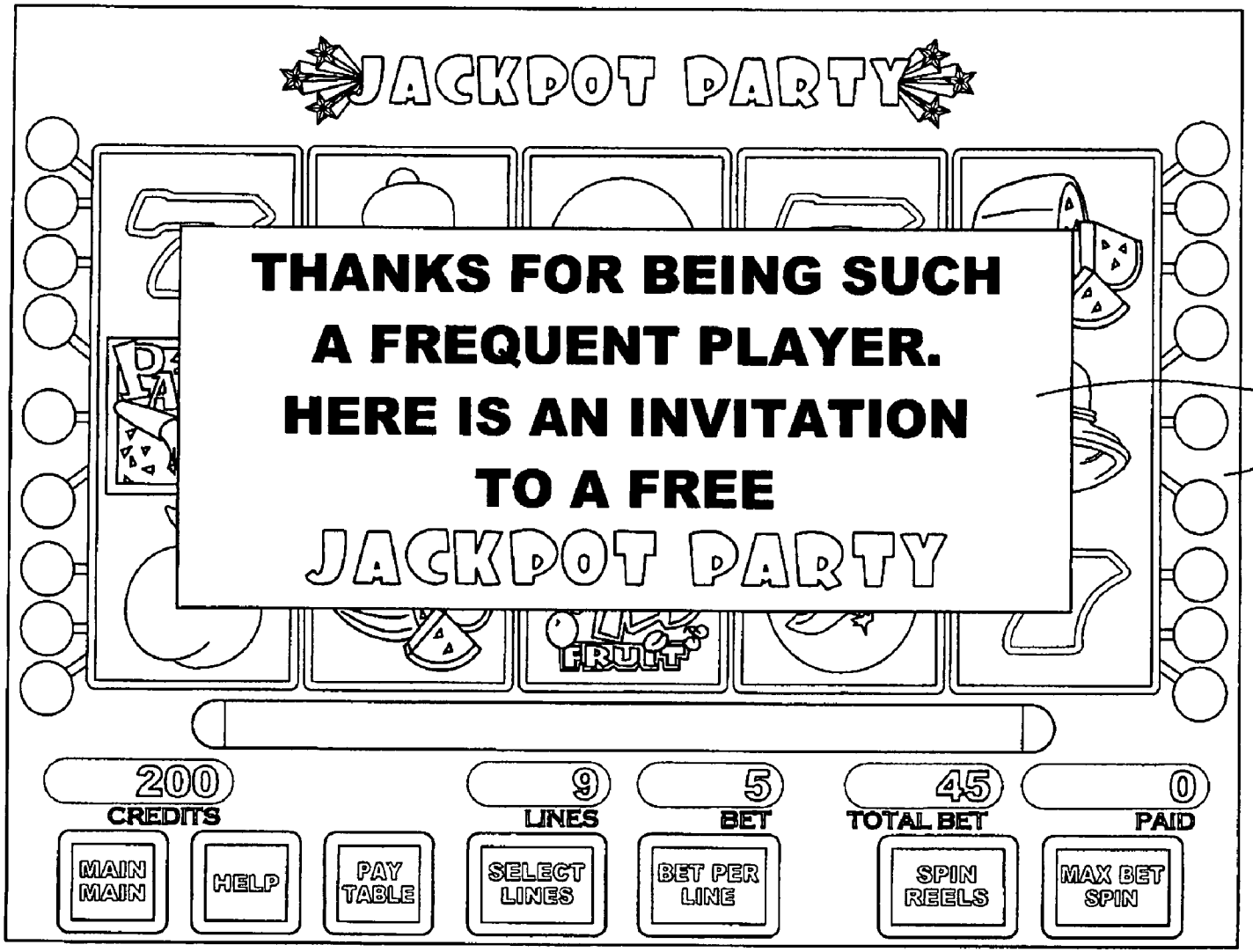
FIG. 3 is a display of one embodiment of the wagering game of the present invention.
Figure 4:
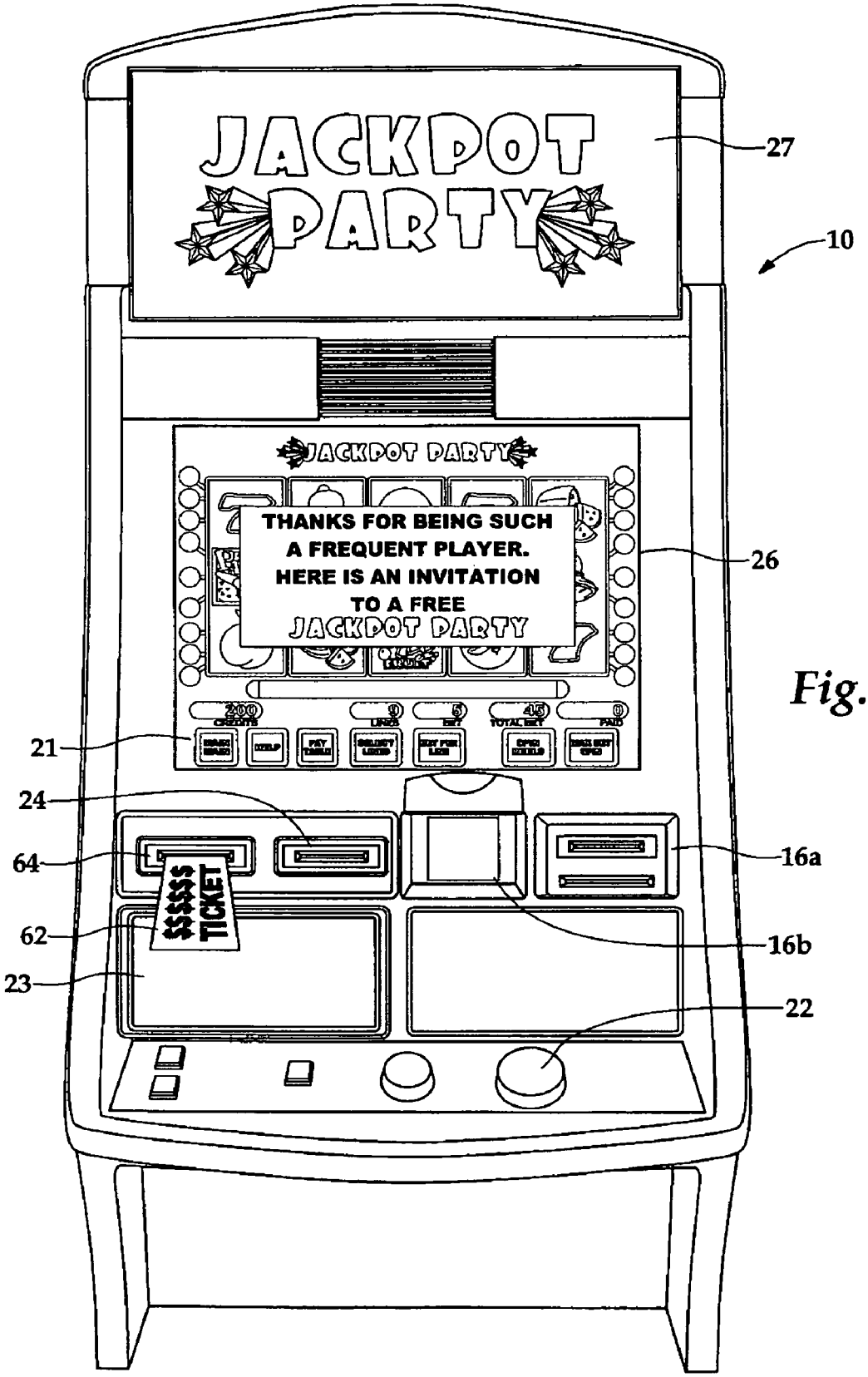
FIG. 4 is a front elevational view of a gaming terminal of the present invention showing an invitation to a bonus game according to the present invention.

Turning now to FIG. 3, an invitation 60 to a wagering game is shown on the main display 26 of one embodiment of the present invention. In this embodiment, the basic wagering game is a slot machine game. According to one embodiment, the invitation 60 allows the player the opportunity to enter the basic game that corresponds to the gaming terminal 10 without having to place a wager, but instead the player redeems the invitation 60. The invitation 60 to the basic game may be used immediately or the invitation 60 may be used at a later time.

The invitation 60 may be issued based on a certain combination of symbols that are used to indicate the randomly selected outcome of the basic wagering game. For example, the player may be required to obtain a certain combination of symbols on an active payline of the main display 26 of the gaming terminal 10, or a "scatter symbol," a symbol appearing anywhere on the main display 26, even on an inactive payline, may cause the gaming terminal 10 to issue the invitation 60. Additionally, the invitation 60 may be issued after a player has wagered a certain amount at a particular gaming session or as a reward for obtaining a certain amount of points with the gaming establishment's players' club. Further, it is contemplated to reward players for being a frequent guest of the gaming establishment, such as wagering multiple times within a number of weeks or months. It is also contemplated that the invitation 60 may be issued in response to a player who is a member of the gaming establishment's players' club who has not wagered at that gaming establishment for a certain period, such as the player has not wagered at the gaming establishment within a given number of weeks or months.

According to another embodiment of the present invention, the invitation 60 allows the player to play a bonus game that corresponds to the gaming terminal 10 without having to place a wager, but instead the player redeems the invitation 60 to enter the bonus game. The invitation 60 to the bonus game may be used immediately or the invitation 60 may be used at a later time. The invitation 60 to play the bonus game may be issued in a similar manner as previously described with regards to the invitation 60 to the basic game, such as a combination of symbols, a certain amount of wagers, or the frequency with which the player has wagered at the gaming establishment.

According to one embodiment of the present invention, the player is presented with the option of redeeming the invitation immediately for the wagering game, or obtaining an invitation for redemption of the wagering game at a later time. The player uses the touch screen 21 or the push-button panel 22 to select between the first award invitation and the second award invitation.

If the player selects the second award invitation it is contemplated that the invitation 60 may contain certain conditions that must occur in order to redeem the second award invitation. For example, the second award invitation may only be redeemable at certain designated periods of time, and/or the second award invitation may only be redeemable at a specific location. Examples of designated periods of time include, but are not limited to, a specific year, a specific month, a specific week, a specific day, or a specific span of hours. Examples of specific locations include, but are not limited to, a specific gaming establishment, a specific bank of gaming terminals, or a specific type of gaming terminal. The gaming establishment may wish to place conditions on the redemption of the second award invitation for a number of reasons, including but not limited to, enticing players to return to the gaming establishment at certain periods of time that are traditionally not as busy for the gaming establishment, generating excitement for wagering games that have recently been introduced at the gaming establishment, increasing gaming activity on wagering games that have not enjoyed a level of wagering that the gaming establishment had hoped for, increasing the amount of play on wagering games that offer the player better odds of winning, encouraging the player to try a different type of wagering game, or simply giving the player an incentive to return to the gaming establishment at some time in the future.

It is additionally contemplated that the second award invitation may not possess any limitations allowing the player to decide when to redeem the second award invitation.

Referring now to FIG. 4, if a player decides to save the invitation 60 for a later time, the gaming terminal 10 issues a ticket 62 from an output 64 that corresponds to the invitation 60 according to one embodiment of the present invention. The ticket 62 allows the player the opportunity to redeem the invitation 60 at a later time. In this manner, when no conditions are placed on the invitation 60, the player may select when to utilize the ticket 62. According to this embodiment, when the player decides to utilize the ticket 62 it is inserted into the information reader 24. The CPU 30 obtains information from the ticket 62 that causes the gaming terminal 10 to offer the player the game that corresponds to the invitation 60 the player had previously received. For example, if the invitation 60 the player had previously received was an invitation to a basic game, the gaming terminal 10 would allow the player the opportunity to play the basic game on the gaming terminal 10 without requiring the player to make a wager when a valid ticket 62 is redeemed. Likewise, if the invitation 60 the player had previously received was an invitation to a bonus game, the gaming terminal 10 would allow the player the opportunity to play the bonus game on the gaming terminal 10 without requiring the player to make a wager when a valid ticket 62 is redeemed.

According to another embodiment of the present invention, if a player decides to save the invitation 60 for a later time, and the invitation 60 contains conditions as previously described that must occur prior to the redemption of the invitation, the gaming terminal 10 issues a ticket 62 from an output 64 that corresponds to the invitation 60. The ticket 62 allows the player the opportunity to redeem the invitation 60 once the conditions for redemption have occurred. According to this embodiment, when the player decides to utilize the ticket 62 it is inserted into the information reader 24. The CPU 30 obtains information from the ticket 62 to verify that the conditions for redemption have occurred. If the CPU 30 determines that the conditions for redemption have occurred, the CPU 30 causes the gaming terminal 10 to offer the player the game that corresponds to the invitation 60 the player had previously received. For example, if the invitation 60 the player had previously received was an invitation to a basic game, the gaming terminal 10 would allow the player the opportunity to play the basic game on the gaming terminal 10 without requiring the player to make a wager when a valid ticket 62 is redeemed. Likewise, if the invitation 60 the player had previously received was an invitation to a bonus game, the gaming terminal 10 would allow the player the opportunity to play the bonus game on the gaming terminal 10 without requiring the player to make a wager when a valid ticket 62 is redeemed.

In a similar manner, if the CPU 30 determines that the conditions for redemption have not occurred, the CPU 30 ensures that the gaming terminal 10 does not offer the player the game that corresponds to the invitation 60. It is contemplated that the main display 26 of the gaming terminal 10 may display a message alerting the player to the fact that the conditions for redemption have not occurred.

It is contemplated that ticket 62 contains a unique identifier that links the ticket 62 to a file contained within the local memory 32 or the system memory 52 located in the game network 50. The file indicates that access to an invitation is available to the player. The use of the game network 50 allows the network 50 to determine if the ticket is acceptable, and may control and allow play at different types of gaming terminals.

It is further contemplated that rather than issuing the ticket 62 to the player, the gaming terminal 10 may instead add the invitation 60 in a file associated with the player, such as the player's gaming establishment's players' club, in the system memory 52 of the game network 50. This way, the invitation 60 is linked to a file associated with the player in the system memory 52, and the player does not have to worry about losing the ticket 62 that before it can be redeemed. It is also contemplated that if the invitation is linked to the player's gaming establishment's players' club file, the player may be reminded that the invitation 60 is available to the player, reducing the chances of the player failing to redeem the invitation 60, further increasing the player's satisfaction. It is further contemplated that the ticket 62 may be replaced by other identifiers, such as the personal identification card, the RFID device, or the biometric identifier as previously described.

In alternative embodiments, a player can use a telephone to access and use one or more of the player's accumulated game assets. For example, using a mobile phone, the player can dial a toll-free phone number to access his or her game assets. A central server associated with the network 50 (FIG. 2) can recognize the player's mobile number for identification purposes, via a caller-id feature, or, alternatively, the central server may require the player to create a unique code number (if, for example, the player uses a caller-id block feature). Optionally, the player may be required to enter an additional code for identifying a specific gaming terminal 10.

Thus, the player can use his or her mobile phone to remotely access the wagering game and utilize the accumulated assets at a time and place according to the player's desire. For example, the player can restart a gaming session via the mobile phone at a point where he or she had previously stopped the session, or the player can choose, via the mobile phone, to play an accumulated bonus game that he or she had previously won, but not played.

In another example, the player can put money into a gaming terminal 10 while the player is physically at the gaming terminal 10. Before the player walks away from the gaming terminal 10, the player can register the gaming terminal 10 to the player's phone. The player can also let the gaming terminal 10 know what assets it may intend to use in the future via remote access by the phone. For example, the player can register the phone number as a password required to access the player's assets on the gaming terminal 10. The player can initiate an auto-play feature while at the gaming terminal 10 or remotely via the phone. The auto-play feature of the gaming terminal 10 is configured to report, e.g., via still or moving images on the phone, one or more of the gaming outcomes. Then, at a later time, the player returns to the gaming terminal 10, re-checks into the gaming terminal via the phone and, optionally, cashes out any winnings. While no actual gameplay occurs on the phone, the phone is used for accessing the player's assets and gaming outcomes on the gaming terminal 10.

Optionally, the wagering game provides the player with access to accumulated assets and/or certain awards only if the player achieves a "Remote Play Winning Outcome." If the player achieves this outcome (e.g., in a basic or bonus game), then he or she is allowed remote access to one or more of the accumulated assets and/or certain awards. For example, if the player achieves the "Remote Play Winning Outcome," the player can have the option to select a smaller award while the player is physically present at the gaming terminal 10 or a larger award if the player uses the telephone. In another example, the player may be given the option to play for smaller awards while the player is physically present at the gaming terminal 10 or for larger awards if the player uses the telephone for gameplay initiation.

Alternative to using a voice telephone call to initiate a game or to access assets and/or awards, as described above, the player can send a text message. For example, the player can send a special code in the text message to log-in using a special number on the gaming terminal 10.

For identification purposes, various verification ways can be used. For example, the player can enter the mobile telephone number into the gaming terminal 10 as a player identification number. When the phone is near, the gaming terminal 10 can detect it and verify the player identification number, e.g., the mobile number. For example, a receiver can be installed in the gaming terminal 10 for detecting a mobile identifier (which may include the mobile number) that is periodically transmitted by mobile phones to the nearest mobile base station. Thus, the gaming terminal 10 would have similar capabilities to the mobile base station.

Alternatively, the gaming terminal 10 can send a voice or text message to the mobile telephone to verify the player's identification number. For example, the gaming terminal 10 can send a text message asking the player to reply to the text message using a predetermined code for confirmation purposes. Optionally, a Bluetooth identifier can be used for logging-in and/or verification purposes, wherein the Bluetooth identifier is unique per phone and/or service carrier.

Special benefits can be offered to a player based on the telephone brand and/or service carrier. For example, predetermined assets can be made available to the player only if they use a telephone of brand X that uses service carrier Y. Optionally, the special benefits can be made available based on the telephone model.

While the present invention has been described with reference to one or more particular embodiments, those skilled in the art will recognize that many changes may be made thereto without departing from the spirit and scope of the present invention. Each of these embodiments and obvious variations thereof is contemplated as falling within the spirit and scope of the claimed invention, which is set forth in the following claims.

What is claimed is:

1. A gaming terminal comprising: a wagering game having a plurality of symbols that indicate a randomly selected outcome of the wagering game; and wherein, in response to an occurrence of a predefined outcome that is less than all possible outcomes of the wagering game during an initial gaming session, the wagering game provides the player with an option to accept only one of a first invitation and a second invitation, the first invitation being immediately redeemable for a subsequent play of the wagering game during the initial gaming session and the second invitation being for a wagering game opportunity redeemable at a subsequent gaming session, the option to accept and the invitations being otherwise unconditional.

2. The gaming terminal of claim 1, further comprising an input device for identifying a player who is wagering at the gaming terminal, and wherein the player's total amount of wagers is determined from information gathered by the input device.

3. The gaming terminal of claim 1, further including a ticket dispenser for dispensing the second invitation for the subsequent gaming session.

4. The gaming terminal of claim 3, wherein the second invitation is a voucher showing the storage of the second invitation in a memory associated with the player.

5. The gaming terminal of claim 1, further including a card dispenser for dispensing the second invitation for the subsequent gaming session.

6. The gaming terminal of claim 1, wherein the subsequent gaming session occurs at a different gaming terminal.

7. The gaming terminal of claim 1, further comprising a display for displaying the plurality of symbols, wherein the option to accept only one of the first invitation and the second invitation is displayed overlaying the plurality of symbols on the display.

8. A method of playing a wagering game, the wagering game having at least a basic game, the method comprising:

conducting the basic game in a first gaming session at a gaming terminal;

displaying a randomly selected outcome of the basic game on a display; and in response to the randomly selected outcome being an invitation-achieving outcome that is less than all possible outcomes of the basic game, awarding the player an option to accept only one of an invitation to a wagering game opportunity redeemable at a later gaming session and an invitation immediately redeemable for a subsequent play of the wagering game during the first gaming session, the option to accept and invitation being otherwise unconditional.

9. The method of claim 8, wherein the invitation is an invitation to play a bonus game.

10. The method of claim 8, wherein the invitation is an invitation to play a basic game.

11. The method of claim 8, wherein the awarding comprises storing an invitation on a storage medium to be accessible at a later time.

12. The method of claim 8, wherein the invitation is an invitation for a basic game having an associated progressive game.

13. A non-transitory computer readable storage medium encoded with instructions for directing a gaming terminal to perform the method of claim 8.

14. The method of claim 8, wherein the option to accept is displayed overlaying the randomly selected outcome of the basic game.

15. A method of playing a wagering game, the wagering game having at least a basic game, the method comprising:

conducting the basic game at a first gaming session on a gaming terminal;

displaying a randomly selected outcome of the basic game on a display of the gaming terminal;

in response to the randomly selected outcome being an invitation-achieving outcome that is less than all possible outcomes of the basic game, awarding an option to accept only one of an invitation immediately redeemable for a subsequent play of the wagering game during the first gaming session and an invitation to play a wagering game at a non-consecutive second gaming session; and in response to receiving an input indicating player acceptance of the invitation to play at the non-consecutive second gaming session, redeeming the invitation to play the wagering game at a different gaming terminal, wherein the option to accept and the invitations are otherwise unconditional.

16. The method of claim 15, wherein the awarding comprises storing the invitation on a storage medium to be accessible at a later time.

17. The method of claim 15, wherein the invitation is an invitation for a basic game having an associated progressive game.

18. A non-transitory computer readable storage medium encoded with instructions for directing a gaming terminal to perform the method of claim 15.

* * * * *